United States Patent [19]

Gange

[11] 4,359,671

[45] Nov. 16, 1982

[54] MODULATOR STRUCTURES AND METHODS FOR MULTI-ELECTRON GUN DISPLAY DEVICES

[75] Inventor: Robert A. Gange, Belle Mead, N.J.

[73] Assignee: RCA Corporation, New York, N.Y.

[21] Appl. No.: 108,125

[22] Filed: Dec. 28, 1979

[51] Int. Cl.[3] ..... H01J 29/70; H01J 29/72

[52] U.S. Cl. ..... 315/366; 313/422

[58] Field of Search ..... 315/366; 313/422

[56] References Cited

U.S. PATENT DOCUMENTS

| | | | |
|---|---|---|---|
| 2,880,365 | 3/1959 | Law et al. | 315/366 |
| 2,904,722 | 9/1959 | Aiken | 315/366 |
| 4,128,784 | 12/1978 | Anderson | 313/422 |
| 4,137,486 | 1/1979 | Schwartz | 315/366 |

FOREIGN PATENT DOCUMENTS 851159 10/1960 United Kingdom .

*Primary Examiner*—Theodore M. Blum

*Attorney, Agent, or Firm*—Eugene M. Whitacre; Dennis H. Irlbeck; Lester L. Hallacher

[57] ABSTRACT

A flat panel display device is composed of a display section and an electron gun section which provides electron beams for forming a visual display on the display section. A line cathode within the electron gun section serves as the electron source. A plurality of electrode pairs are voltage biased to establish the conditions under which electrons are ejected from the cathode and also to focus electron beams for propagation along the display section.

8 Claims, 4 Drawing Figures

MODULATOR STRUCTURES AND METHODS FOR MULTI-ELECTRON GUN DISPLAY DEVICES

BACKGROUND OF THE INVENTION

This invention relates generally to a flat panel display device having a plurality of electron guns for providing electron beams to electron beam guides and particularly to modulator structures for such a display device.

U.S. Pat. No. 4,128,784 to C. H. Anderson entitled "Beam Guide With Beam Injection Means," describes a beam guide for use in a flat panel cathodoluminiescent display device. The display device is composed of an evacuated envelope containing a plurality of internal support walls which divide the envelope into a plurality of parallel channels. Each channel contains a beam guide extending along one wall of the envelope. An electron gun structure emits electrons which are launched into the beam guides as electron beams. The beam guides include a pair of spaced parallel meshes extending along and spaced from the backwall of the envelope. The meshes contain a plurality of aligned apertures with the apertures being arranged in columns extending longitudinally along the paths of the beams. Each longitudinal column of apertures constitutes a separate beam guide. The apertures also are arranged in rows transversely of the guides. One line of the visual display is generated by ejecting the electron beams out of the guide through the apertures in a single row.

Copending Application Ser. No. 87,451 filed Oct. 22, 1979 by W. W. Siekanowicz, et al. entitled "Modulator With Variable Launch Conditions For Multi-Electron Gun Display Devices," now U.S. Pat. No. 4,263,529 a flat panel display including multiple beam channels each of which encloses guide meshes extending along the length of the channels. Each of the channels includes modulation electrodes and cathode means which provide modulated electron beams to the guide meshes. The guide meshes extend between the modulation electrodes, and the electron beams are propagated along the channels in the space between the meshes. A plurality of pairs of launch electrodes are arranged to span the beam guide meshes. The conditions under which electrons are launched into the space between the guide meshes can be selected by the application of various biasing potentials to the pairs of launch electrodes. Accordingly, conditions under which electrons are launched into the propagation space can be selected substantially independently of the conditions required for operation of the cathode and modulation electrodes.

SUMMARY OF THE INVENTION

A flat panel display device includes an evacuated envelope. The envelope encloses beam guides and cathode means which provide electrons to the beam guides. A plurality of electrode pairs is arranged between the cathode and the beam guides. The application of various combinations of biasing potentials to the electrode pairs permits focusing of the electron beams prior to their injection between the beam guides and allows the use of higher potentials to attract electrons from the cathode.

DETAILED DESCRIPTION OF THE PREFERRED EMBODIMENT

Figure 1:
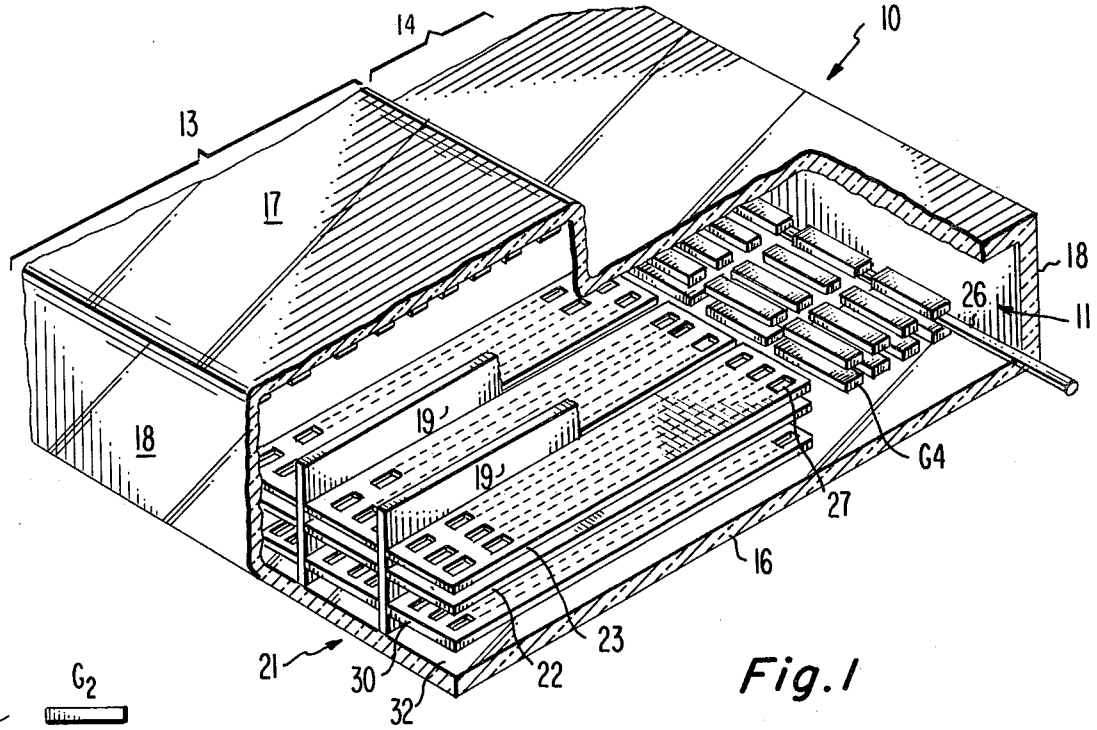
FIG. 1 is a perspective view, partially broken away, of a prior art display device in which the preferred embodiment can be used.

FIG. 1 shows one form of a flat panel display device which incorporates the preferred embodiment. The display device is generally designated as 10 and includes an evacuated envelope 11 having a display section 13 and an electron gun section 14. The envelope 11 includes a rectangular frontwall 16 and a rectangular backwall 17 in spaced parallel relationship with the frontwall 16. The frontwall 16 and the backwall 17 are connected by four sidewalls 18. A display screen 32 is positioned along the frontwall 16 and gives a visual output when impacted by electrons.

A plurality of spaced parallel support vanes 19 are secured between the frontwall 16 and the backwall 17 and extend from the gun section 14 to the opposite sidewall 18. The support vanes 19 provide the desired internal support against external atmospheric pressure and divide the envelope 11 into a plurality of channels 21. Each of the channels 21 encloses a beam guide assembly of the type described in U.S. Pat. No. 4,128,784. The beam guide assemblies include a pair of spaced parallel beam guide meshes 22 and 23 extending transversely across the channels and longitudinally along the channels from the gun section 14 to the opposite sidewall 18. A focus grid 30 is positioned between the guide mesh 22 and the display screen 32. The screen 32 luminesces when impacted by electrons.

Figure 2:
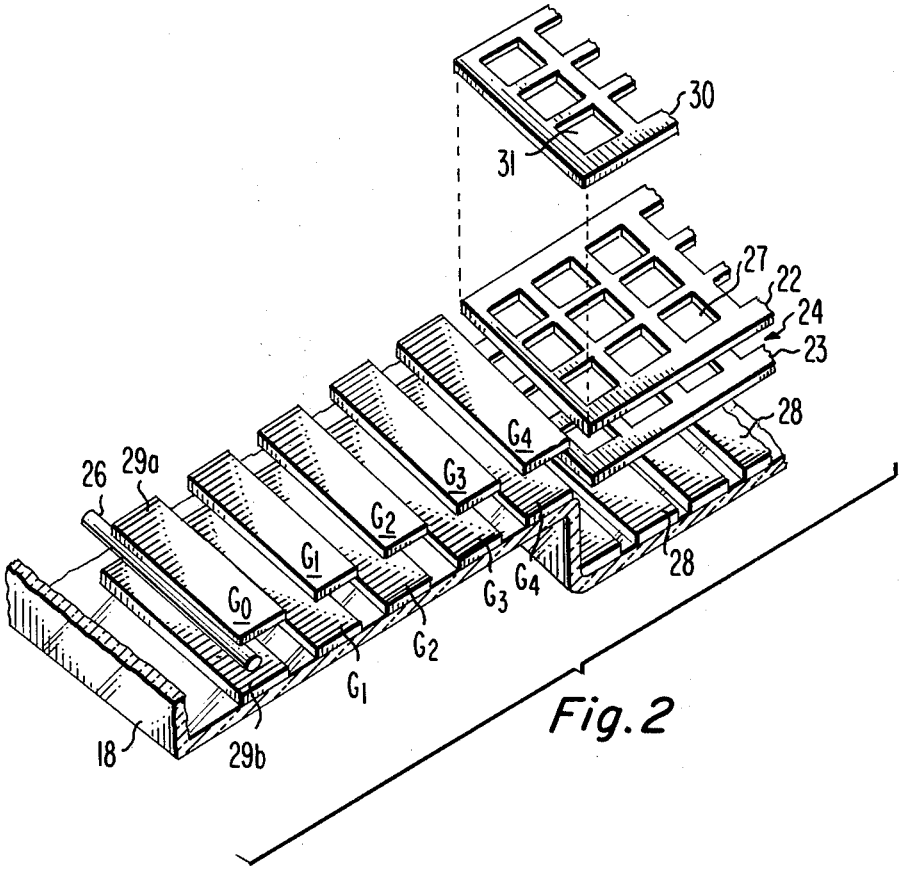
FIG. 2 is a perspective view of a preferred embodiment of the invention.

FIG. 2 shows the electron gun section 14 in greater detail. The guide meshes 22 and 23 are parallel to the backwall 17 and are separated by a space 24 in which the electrons emitted by the cathode 26 propagate between the two guide meshes. Both of the guide meshes contain a plurality of apertures 27 which are arranged longitudinally in columns and transversely in rows. Positioned on the backwall 17 are a plurality of extraction electrodes 28 which are arranged parallel to the transverse rows of apertures 27. Electrons emitted from the cathode 26 are injected into the space 24 between the guide meshes 22 and 23 and are propagated along the columns of apertures 27 with each of the columns serving as one beam guide. The extraction electrodes 28 serve a dual purpose in that these electrodes are positively biased, for example +350 volts, so that the positive biasing potentials cooperate with a biasing potential placed upon the focus grid 30 to create electrostatic fields. The electrostatic fields penetrate the apertures 27 to focus the electron beams in the vicinity of the center of the space 24 between the guide meshes 22 and 23. The extraction electrodes 28 also serve to extract the electron beams from between the guide meshes. Thus, when the electron beams are to be extracted from between the guide meshes and directed toward the display screen 32, a negative voltage, for example −100 volts, is applied to one of the extraction electrodes 28. This negative voltage repels the electron beams through the apertures 27 of the guide mesh 22. The electron beams then pass through the apertures 31 of the focus electrode 30 and travel to the display screen 32 to form one line of the visual display.

The cathode 26 is arranged between a "G0" pair of electrodes identified as 29*a* and 29*b*. Longitudinally arranged between the G0 electrode pair and the guide meshes 22 and 23 is a plurality of electrode pairs G1, G2, G3 and G4. The electrode pairs G0–G4 extend transversely across the channels 21 and the electrodes of each pair are spaced by a distance which is equal to the spacing 24 between the guide meshes 22 and 23. Accordingly, the electrode pairs G0–G4 and the guide meshes 22 and 23 are coplanar and are parallel to the display screen 32.

Figure 3:
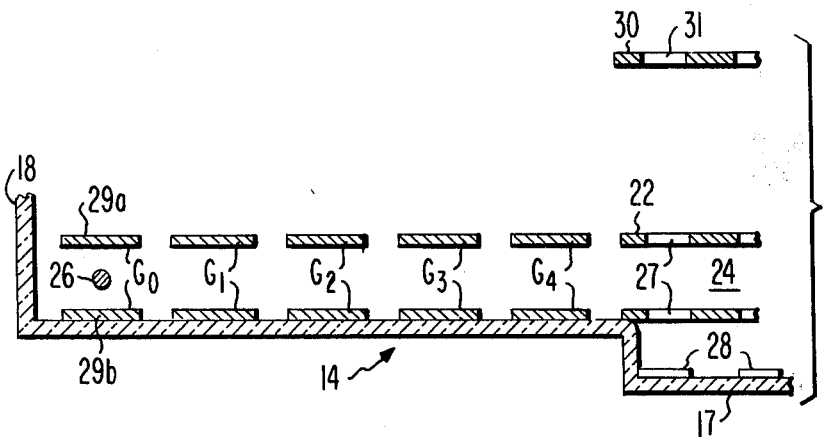
FIG. 3 is a cross sectional view of the preferred embodiment in FIG. 2.

As best shown in FIG. 3, electrode pairs G1 through G4 are included within electron gun section 14 and thus are positioned outside of the display section 13 (FIG. 1). Accordingly, the transverse row of apertures 27 which is nearest to the electrode pair G4 is the first row of apertures which can contribute to the visual display of the device. For this reason the electrodes G1 through G4 are substantially unaffected by the biasing potential applied to the focusing grid 30 which is positioned between the display screen 32 and the guide meshes in the display section 13.

Figure 4:
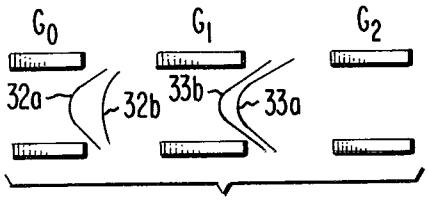
FIG. 4 shows equipotentials developed with various biasing potentials on the electrode pairs.

The utilization of the G1–G4 electrode pairs permits substantial flexibility in the modulation techniques used to inject electrons into the space 24 between the guide meshes 22 and 23 and yields higher electron velocities into the guide at injection. This is desirable because the electrons are exposed to possible mechanical structural variations for shorter time periods, thereby minimizing the deleterious consequences of such defects. One type of modulation which can be used hereinafter is called G1 modulation. When this modulation technique is employed the G0 electrode pair is biased at a fixed negative potential while the G2 electrode pair is biased at a fixed positive potential. Control of electrons emitted by the cathode 26 then is effected by varying the biasing potential applied to the G1 pair of modulation electrodes. With the fixed biasing potentials applied to the electrode pairs G0 and G2 repectively set at −100 and +300 volts the electrostatic lenses between the G0–G1 and G1–G2 electrode pairs change as the biasing potential applied to the G1 modulation electrode pair varies between 0 and −100 volts. As shown in FIG. 4, with a 0 volt potential on the G1 pair, a potential of −100 volts on the G0 pair causes a relatively deep penetration of the resulting field into the $G_0$ pair as indicated by the exemplary equipotential 32*a*. The electrostatic lens between the G1–G2 electrodes is relatively strong and there also is penetration of the field between these two pairs, as indicated by the exemplary equipotential 33*a* in FIG. 4. As the biasing potential applied to the G1 pair of electrodes approaches −100 volts, the equipotentials between the pairs of electrodes change dramatically. The potentials on the G0 and G1 electrode pairs approach equality so that there is very little field penetration into the $G_0$ pair, this is indicated by equipotential 32*b* in FIG. 4. When the biasing potential on the G1 pair reaches −100 volts, a field free region exists between the G0 and G1 pairs. However, because of the increased voltage difference between the G1 and G2 electrode pairs there is increased penetration between these electrode pairs as indicated by the exemplary equipotential 33*b* in FIG. 4. Obviously as the potential on the G1 electrode pair changes from 0 to −100 volts the equipotentials vary between the configurations shown in FIG. 4.

Variations in the potential on the G1 electrode pair cause changes in the trajectory of the electrons emanating from the cathode 26. For this reason, the biasing potential applied to the G3 pair is used to focus the electrons at a position which is substantially midway between the guide meshes 22 and 23. This is accomplished by setting the potential V3 on the G3 pair at a value $V3=\sqrt{V2V4}$ where V2 and V4 are the biasing potentials applied to the G2 and G4 electrode pairs respectively. The potential V2 is +300 volts as explained hereinabove. The potential on the G4 pair is selected in accordance with the system geometry, and with a spacing in the order of 50 mils this potential typically will be +350 volts. Accordingly, the biasing potential V3 on the G3 electrode pair is determined by the potentials on the G2 and G4 pairs and focuses the electron beam in the vicinity of the center of the space 24 between the guide meshes 22 and 23. The electron beams, therefore, enter the space 24 between the guide meshes focused. This focusing is maintained by the interaction of the positive biasing potentials applied to the guide meshes 22 and 23, the extraction electrodes 28, and the focusing grid 30 on the other side of the guide meshes.

Another type of modulation which can be used with the modulation structure described herein is called G2 modulation. In this type of modulation the G0 and G1 electrode pairs are both fixed at substantially 0 potential. With an examplary spacing between the guide meshes 22 and 23 of 50 mils, a biasing potential of +100 volts on the G2 pair will cause an electron beam current which is adequate for operational purposes to flow. Accordingly, the beam current can be controlled by varying the G2 biasing potential between 0 and +100 volts.

This type of modulation is desirable because the potential on the G2 modulation electrode pair is the only potential in the cathode region and, therefore, changes in the V2 voltage do not alter the trajectories of the electrons emanating from cathode 26. Accordingly, the focusing of the electron beam does not change. However, the velocities of the electrons increase as the V2 potential increases and, therefore, variations in the mechanical structure of the system have less detrimental effect at the higher current levels where improved tolerance is desirable because the increased velocity exposes the electron beams to the variations for a shorter period of time. However, the potential V3 which biases the electrode pair G3 must be changed as V2 is changed to insure that the electron beams remain substantially parallel. This potential focuses the electron beams midway between the G3 electrodes so that the electron beams are injected between the guide meshes 22 and 23 substantially at the center of space 24. The focusing potentials applied to the guide meshes 22 and 23, the extraction electrodes 28 and the focusing grid 30 coact to retain this focusing as the beams propagate the length of the guide meshes.

Irrespective of whether the G1 or G2 modulation technique is utilized a substantial advantage is realized because the maximum emission level of electrons from the cathode 26 can be controlled substantially independently of the potential selected for the guide meshes 22 and 23. Additionally, the initial focusing between the modulation electrodes is independent of the fixed potentials which are applied to the extraction electrodes and the focusing mesh. Accordingly, the potentials which focus the electrons into the space between the guide meshes can be selected substantially independently from those used to periodically focus the beam down the guide or to extract the beam from the guide. Also, the location tolerances of electrodes near the cathode are very good because they are deposited onto high quality surfaces.

I claim:

1. In a display device including an evacuated envelope housing a display section and an electron gun section, said display section including a display surface and a pair of spaced parallel guide meshes for propagating electron beams in a space between said guide meshes and parallel to said display surface, said electron gun section including cathode means for providing electrons, means arranged between said cathode means and said guide meshes for injecting said electrons into said space, an improvement wherein:

said means for injecting electrons includes a plurality of pairs of electrodes arranged to receive said electrons from said cathode means and input said electrons to said space between said guide meshes, at least two of said pairs of electrodes being biased with fixed voltages and one pair of said electrodes being biased with a varying voltage, said cathode being arranged between the pair of electrodes furtherest from said guide meshes.

2. The display device of claim 1 further including a fourth pair and a fifth pair of electrodes arranged between said third pair of electrodes and said electron beam guide means.

3. The display device of claim 1 wherein said pair of electrodes furtherest from said guide meshes is the first pair and is biased with a fixed negative voltage, the second pair of said electrodes is biased with said varying voltage, and the third pair of said electrodes is biased with a fixed positive voltage.

4. The display device of claim 1 wherein said pair of electrodes furtherest from said guide meshes is the first pair and is biased with a fixed voltage, the second pair of said electrodes is biased with a fixed voltage, and the third pair of electrodes is biased with said varying voltage.

5. A method of modulating a display device having a display section and an electron gun section, said display section including a pair of spaced parallel guide meshes for propagating electrons; the electron gun section including a cathode for emitting said electrons, a plurality of pairs of electrodes arranged between said cathode and said guide meshes, said cathode being positioned between the first pair of electrodes; comprising the steps of:

applying a fixed negative biasing potential to the first pair of electrodes, a fixed positive biasing potential to the third pair of electrodes and a varying potential to the second pair of electrodes.

6. The method of claim 5 further including the steps of biasing a fourth pair of said electrodes with a potential $V4=\sqrt{V3V5}$ where V3 is the biasing potential on said third pair of electrodes and V5 is the biasing potential on a fifth pair of said electrodes.

7. A method of modulating a display device having a display section and an electron gun section, the display section including a pair of spaced parallel guide meshes for propagating electrons, the electron gun section including a cathode for emitting said electrons, a plurality of pairs of electrodes arranged between said cathode and said guide meshes; said cathode between the first pair of electrodes; comprising the steps of:

applying a fixed potential to the first pair of electrodes, a fixed biasing potential to the second pair of electrodes and a variable potential to the third pair of electrodes.

8. The method of claim 7 further including the step of making the fixed biasing potentials equal.

* * * * *